United States Patent [19]

Cameron et al.

[11] Patent Number: 4,930,401

[45] Date of Patent: Jun. 5, 1990

[54] VALVE SYSTEM AND ARRANGEMENT FOR ON-LINE VALVE REPLACEMENT

[75] Inventors: Russell J. Cameron, Rochester; Richard P. Krape, Lake Orion; Robert N. Winsand, Birmingham, all of Mich.

[73] Assignee: Ross Operating Valve Company, Troy, Mich.

[21] Appl. No.: 263,690

[22] Filed: Oct. 28, 1988

[51] Int. Cl.[5] ..... F15B 13/04

[52] U.S. Cl. ..... 91/32; 91/418; 137/884; 137/863; 137/869; 251/149

[58] Field of Search ..... 91/20, 32, 358 R, 360, 91/418, 363 A; 137/884; 251/149

[56] References Cited

U.S. PATENT DOCUMENTS

| | | | |
|---|---|---|---|
| 2,635,584 | 4/1953 | Jacques | 91/32 |
| 3,505,929 | 4/1970 | Coppola et al. | 91/1 |
| 3,813,990 | 6/1974 | Coppola et al. | 91/20 |
| 4,054,154 | 10/1977 | Mason | 91/459 |
| 4,257,311 | 3/1981 | Barnsley et al. | 91/363 A |
| 4,280,531 | 7/1981 | Milberger et al. | 137/624.11 |

FOREIGN PATENT DOCUMENTS

| | | |
|---|---|---|
| 1426501 | 12/1968 | Fed. Rep. of Germany . |
| 2307151 | 11/1977 | France . |
| 643919 | 6/1984 | Switzerland . |
| 666943 | 8/1988 | Switzerland . |

*Primary Examiner*—Edward K. Look
*Assistant Examiner*—John E. Ryznic
*Attorney, Agent, or Firm*—Harness, Dickey & Pierce

[57] ABSTRACT

Several embodiments are disclosed of an automatic shutoff valve apparatus for permitting removal, repair, or replacement of a control valve from a mounting base without deactivating a complete system. In addition, a redundancy arrangement is disclosed wherein the shutoff valve apparatus and at least two control valves are employed in parallel so that the device activated by the control valves can be maintained operative when one control valve malfunctions or is removed, repaired, or replaced.

13 Claims, 10 Drawing Sheets

VALVE SYSTEM AND ARRANGEMENT FOR ON-LINE VALVE REPLACEMENT

BACKGROUND AND SUMMARY OF THE INVENTION

This invention relates to control valve arrangements for fluid systems and more particularly to providing improved productivity, uptime, and service replacement for such valves.

In many (if not all) fluid systems, one or more control valves are extremely critical to the functioning of the system. This is particularly true in connection with various types of machine tools or other manufacturing apparatuses wherein the control valves control certain operational functions. Because of the criticality and need for high performance, it is extremely desirable to insure that a system is provided wherein the entire operation will not be shut down if a defect occurs in one of the control valves. Therefore, one of the principal objects of this invention is to provide an improved control valve arrangement and replacement system for such apparatuses wherein failure of one control valve of the system will not render the entire system inoperative.

In connection with systems of this type it is extremely important that an arrangement be incorporated wherein a defective or malfunctioning control valve may be rapidly and conveniently replaced. That is, it is important to insure that a disabled control valve can be quickly removed for servicing and that the removal of this control valve does not shut the entire system down. Therefore, the present invention seeks to provide an improved and simplified arrangement for facilitating removal of a control valve for servicing or repair for a system without disabling the entire system.

The principles of the invention can be embodied in any of several forms that in most cases fall into one of four general categories. In one such category, an arrangement is provided wherein the failure or removal of a control valve results in maintaining the "status quo" of the overall system, i.e., maintaining an "air-on", pressurized condition. In this general category, as with the others discussed below, the apparatus for accomplishing this result can optionally be housed in a separate device or "block" interposed between the control valve and a system base. Such a system base has a plurality of flow ports sized and configured to match and align with the flow ports on the control valve, and but for the presence of the present invention, the control valve would normally have been mounted directly onto the system base. Thus, in order to allow for such a block to be interposed between the control valve and the base, the block must also have correspondingly sized and configured flow ports on both the control valve side and the base side of the block. Alternatively, the functional features of the interposed block can be housed or embodied directly in the system base, thus allowing for direct mounting of the control valve onto the base.

In a second general category, a pair of full-capacity control valves are provided, one of which being redundant or a backup with respect to the other, and thus only one control valve functions at a time. Each of such control valves is mounted onto a separate block somewhat similar to that described above and embodying the present invention. The blocks are mounted in turn onto the system base in an interposed relationship and function automatically to deactivate and isolate the functioning control valve in the event of its failure or removal and to activate the redundant or backup control valve, connecting it to the system for continued operation. Alternatively, the functional features of the separate interposed blocks can be housed or embodied directly in the system base, thus allowing for direct control valve mounting in a manner similar to that discussed above in connection with the first general category.

The third general category is functionally similar to the second general category discussed above (one of a number of full-capacity control valves functions at a time), except that the functional features of the separate interposed block are housed or embodied in a common block interposed between the two control valves and the system base. Alternatively, these functional features can be housed or embodied in the system base, and such an arrangement would thus be substantially the same, at least in function, as the above-discussed alternate arrangement for the second general category.

Finally, the fourth general category provides for a number of control valves functioning simultaneously under normal conditions. However, each of the control valves is over-sized with respect to such normal conditions, such that the failure or removal of one control valve leaves sufficient control valve capacity to allow for full, normal operation of the fluid system. In such an arrangement the present invention provides for maintenance of the "status quo" with respect to the failed or removed control valve in a manner generally similar to that described above in connection with the first general category.

An example of one arrangement falling within the fourth general category described above includes three or more half-capacity control valves, and thus allows for full system operation even if one of the control valves fails or is removed for service. According to the present invention, such "switching" between the operation of all valves and the operation of less than all valves occurs automatically in order to substantially eliminate, or at least minimize, system downtime. As with the other categories discussed above, the functional features of the invention can be housed or embodied in separate interposed blocks, in a common interposed block, or in the system base. The features of the invention described and illustrated herein, by way of merely exemplary embodiments, all fall generally into one or more of the four categories discussed above.

An advantage of most (if not all) embodiments of the present invention, and the preferred, proximal positioning of shutoff valves or other components of the invention with the control valves and the base, is to allow the control valves and the base to be under operative pressure so as to minimize pressure drop when one or the other of the control valves is activated during on-line operation of the system. This also allows for alternate employment of the control valves so as to eliminate the long term idleness of any one control valve. In addition, the alternate switching from one control valve to the other allows for important on-line functional testing of system components on a periodic basis.

One arrangement of the invention is adapted to be embodied in a control valve arrangement for a system having a powered device, such as an air cylinder or a hydraulic cylinder, for example, with a plurality of ports that are selectively communicated with a source of working fluid pressure or exhaust. A first control valve is movable between at least two positions, and a second control valve is likewise movable between at least two positions. Fluid circuitry communicates the first and second control valves in parallel with a source of working fluid pressure, with the ports of the powered device, and preferably also with an exhaust. First and second shutoff valves are provided in the fluid circuitry and are operable with the first and second control valves for selectively isolating the control valves from the working fluid pressure source, from the ports of the powered device, and in some cases from the exhaust, for replacement of one of the control valves with the other of the control valves controlling the powered device, thus effectively "switching" from a normal condition to a backup or redundant condition.

The embodiments of the invention are adapted to be used in combination with a base and a control valve having a mounting surface, wherein a shutoff valve assembly is interposed between the control valve and the base, or incorporated into the base. The shutoff valve assembly comprises a housing and internal workings with the housing having a surface on which the control valve mounting surface is removably mounted. Matching supply and outlet ports are formed in these surfaces and communicate with supply and outlet passages in the housing. Shutoff valve means are shiftably mounted in the housing for controlling the passages and are movable between an inactive or open position and a shutoff position. The shutoff valve assembly is responsive to fluid pressure changes caused by removal of the control valve mounting surface from the shutoff valve surface for causing the shutoff valve means to change from a normal condition to a shutoff condition. In addition, in at least some embodiments, the shutoff valve assembly can be manually activated to change from the normal condition to the shutoff condition.

Additional objects, advantages, and features of the present invention will become apparent from the following description and appended claims, taken in conjunction with the accompanying drawings.

DETAILED DESCRIPTION OF THE PREFERRED EMBODIMENTS

Disclosed in this application are a number of shutoff valve assemblies and applications for such assemblies for substantially reducing or fully eliminating downtime in various control circuits including a fluid pressure source, a return, a pneumatically operated device (or other fluid-operated device) and a control valve for controlling the communication between the source, the pneumatically operated device, and the exhaust. It should be noted that although the invention is described for purposes of illustration as applied to pneumatic systems, the principals of the invention are also applicable to other fluid systems, and to physical configurations other than the illustrative examples shown and described herein.

Figure 1:
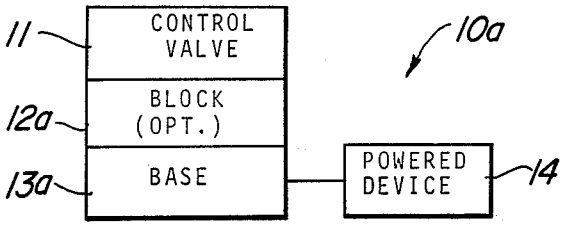
FIG. 1 illustrates, in block diagram form, one of the four general categories of the present invention, in which failure or removal of a control valve maintains the pressurized, air-on condition of the system even though the failed or removed control valve is thus inoperative.

In FIG. 1, a system 10*a* is schematically illustrated in diagrammatic block form, and includes a control valve 11 mounted on an optional interposed block 12*a* for providing fluid communication between the control valve 11 and a system base 13*a*. The system is adapted for controlling a pneumatic or hydraulic powered device 14, such as a pneumatic or hydraulic cylinder, for example. The form of the present invention illustrated in FIG. 1 is representative of the above-mentioned first general category, wherein the failure or removal of the control valve 11 results in a pressurized, "air-on" condition for the system 10*a*, which essentially maintains the "status quo", thus allowing for convenient removal and replacement of the control valve 11 without necessarily shutting down the entire system, of which the powered device 14 can be a part.

Figure 2:
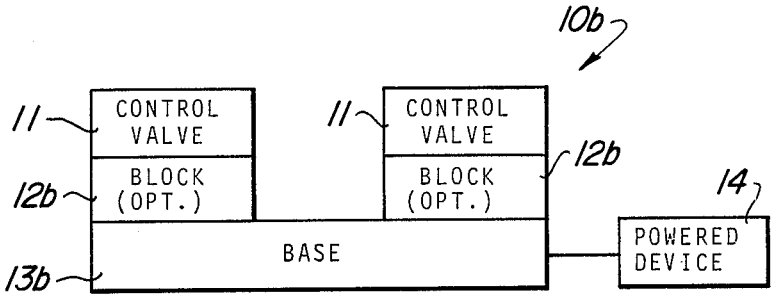
FIG. 2 illustrates another block diagram in which the functional features of the present invention are housed within separate interposed blocks, each between one of the redundant control valves and the system base, or optionally incorporated into the base itself.

In FIG. 2, the system 10*b* is illustrated in diagrammatic block form, wherein the powered device 14 is controlled by a pair of full-capacity control valves 11, one of which being redundant or a backup with respect to the other. Thus, only one of the control valves 11 functions at any given time, and each of the control valves 11 is mounted onto a separate, optional, interposed block 12*b*, with the blocks 12*b* being mounted for fluid communication with a system base 13*b*. The system 10*b* functions to automatically deactivate and isolate the initially functioning control valve 11, in the event of its failure or removal, and to activate the redundant or backup control valve 11, connecting it to the system for continued operation of the powered device 14.

Figure 3:
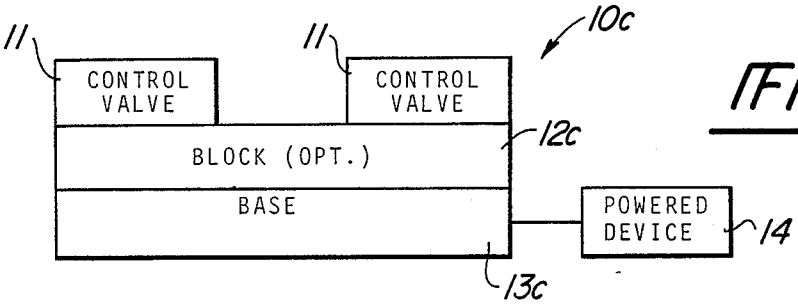
FIG. 3 is similar to FIG. 2, except that the separate optional interposed blocks are replaced by a common optional interposed block.

In FIG. 3, the above-mentioned third general category is represented in diagrammatic block form, and functions in a manner similar to that of the second general category illustrated in diagrammatic block form in FIG. 2, except that the functional features of the separate and optional interposed blocks 12*b* are housed or embodied in a common, optional, interposed block 12*c* connected for fluid communication between the control valves 11 and the system base 13*c*.

Figure 4:
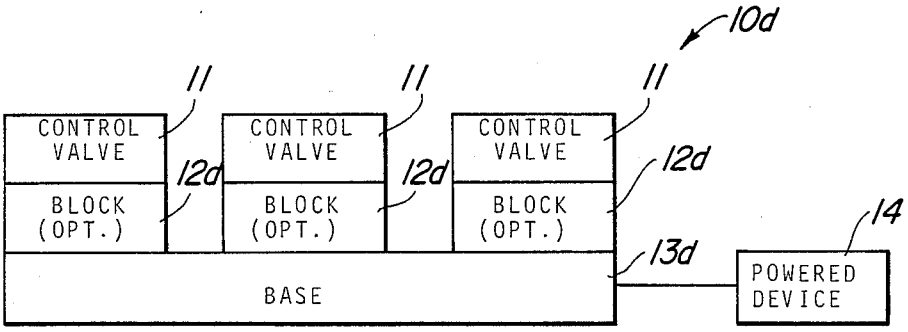
FIG. 4 illustrates, in block diagram form, another general category of the present invention in which a number of excess-capacity control valves normally function simultaneously and are mounted onto either separate or common interposed blocks, or directly onto the system base, with the remaining valves being sufficient for full-capacity system operation in the event of failure or replacement of one or more of the control valves.

In FIG. 4, the fourth general category mentioned above is illustrated in diagrammatic block form, wherein a number of control valves 11 function simultaneously under normal conditions. However, each of the control valves 11 is over-sized, with respect to such normal conditions, such that the failure or removal of one of the control valves 11 leaves sufficient control valve capacity to allow for full, normal operation of the powered device 14. As mentioned above, the system 10*d* shown in FIG. 4 maintains the "status quo" with respect to the failed or removed control valve in a manner generally similar to that described above in connection with the system 10*a* shown in FIG. 1.

It should be noted that any of the optional interposed blocks 12*a*, 12*b*, 12*c*, or 12*d*, can be eliminated, with their functional features being incorporated directly into the respective system base 13*a*, 13*b*, 13*c* or 13*d*. Because of this, the various examples of the principles of the present invention illustrated in the remaining figures do not necessarily distinguish as to whether the functional components for effecting the desired result in a given application are housed in a separate interposed block (interposed between one or more control valves and the system base), or housed or embodied directly into the system base itself. The remaining figures do, however, at least schematically illustrate various embodiments or applications of the general arrangements shown in the four general categories illustrated in FIGS. 1 through 4. In this regard, it should further be noted that the various principles of the present invention shown for purposes of illustration in the remaining figures are in whole or in part applicable to one or more of the general categories illustrated in FIGS. 1 through 4, as well as other arrangements that will become apparent to those skilled in the art.

Figure 5:
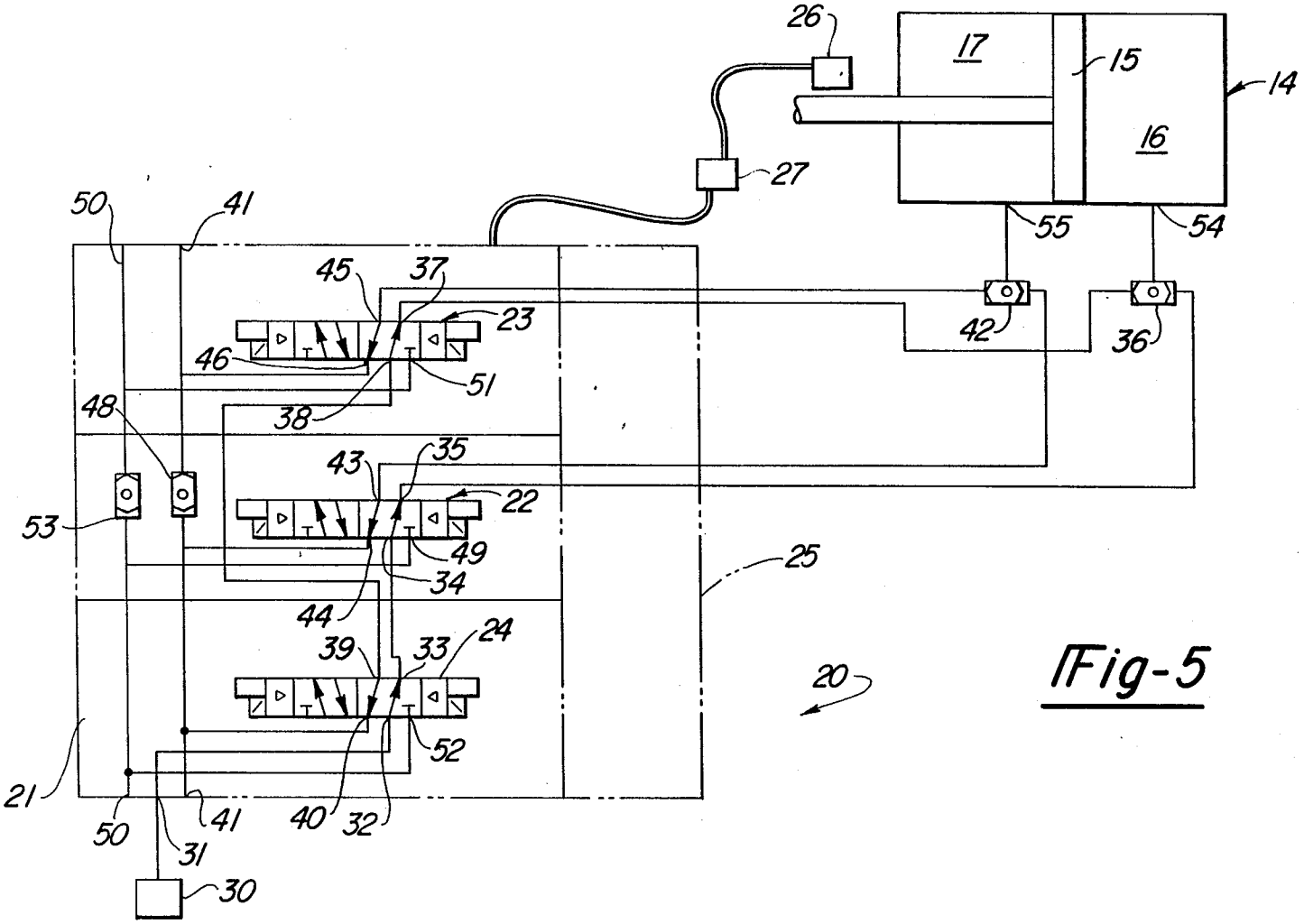
FIG. 5 is a diagrammatic or schematic drawing showing one example of a control system circuit in accordance with FIGS. 3 or 4 for a device, such as a pneumatic or hydraulic motor, for example.

FIG. 5 illustrates one of many exemplary arrangements or embodiments in accordance with the present invention, wherein an overall system 20 is provided for controlling a powered fluid cylinder 14 (or other such fluid-powered device), wherein a piston 15 is disposed for reciprocable movement and divides the cylinder 14 into two fluid chambers 16 and 17. System 20 includes an interposed block 21, which can be a separate component interposed between a pair of control valves 22 and 23 and a system base 25, or which can optionally be incorporated directly into the system base 25. It should be understood, however, that the illustration of the present invention in FIG. 5 is merely schematic or diagrammatic, and neither necessitates or precludes either of the aforementioned physical arrangements.

In the illustrative example shown in FIG. 5, a position sensor 26, or a limit switch, or other such sensing device, is provided for monitoring and sensing the position (or other system parameters) of the fluid-powered cylinder 14. The sensor 26 communicates with a signal processor 27 (microprocessor or other such processor) in order to control the operation of the control valves 22 and 23, as well as a selector or shutoff valve 24. Such communication between the sensor 26 and the signal processor 27, as well as between the signal processor 27 and the control valves 22 and 23 and the selector valve 24, can be accomplished by electric or electronic means, pneumatic means, hydraulic means, or in other ways well-known to those skilled in the art. In the illustrative example shown in FIG. 5, however, it is preferred that the sensing signals and controls of the control valves 22 and 23 and the selector valve 24 be accomplished by way of electronic signals.

A source of working fluid pressure 30 is connected with an inlet 31, which is in fluid communication with a supply port 32 on one side of the selector valve 24. A corresponding port 33 on the selector valve 24 provides fluid communication with an inlet or supply port 34 on the first control valve 22.

When the movable control valve 22 is in the position shown in FIG. 5, fluid communication is provided between the supply port 34 and a load port 35 in fluid communication with one side of a shuttle valve 36. Such fluid communication causes the shuttle valve to move to the left, as shown in FIG. 5, thus allowing for continued fluid communication between the load port 35 of the control valve 22 and the chamber 16 of the fluid-powered cylinder 14. Such a condition causes the fluid chamber 16 to be pressurized, thus forcing the piston 15 to move leftward, as shown in FIG. 5. In this position, and in this operating condition, the opposite side of the shuttle valve 36 is closed off, thus preventing fluid communication between a load port 37 on the control valve 23, thus rendering the control valve 23 inoperable to cause movement of the piston 15 in the fluid-powered cylinder 14. Rather, with the control valve 23 in the position illustrated in FIG. 5, the load port 37 of the control valve 23 is in fluid communication by way of a supply port 38 and a pair of ports 39 and 40 on the selector valve 24 with an exhaust port 41 on the block or base 21. Also in this condition, the exhaust ports 51 and 49 on the control valves 23 and 22, respectively, are blocked off.

During the above-described leftward movement of the piston 15, the fluid chamber 17 is in fluid communication by way of a second shuttle valve 42 with a load port 43 on the control valve 22, which in turn is in fluid communication with an exhaust port 44 connected for fluid communication with the exhaust port 41. This allows for the depressurization of the chamber 17 simultaneously with the pressurization of the chamber 16, thus facilitating the above-described leftward movement of the piston 15.

It should also be noted that in this piston position, and in the operating condition thus far described, the load port 45 on the control valve 23 is in communication with the exhaust port 46 on the control valve 23, which is in turn connected with the opposite end of the exhaust port 41 of the block or base 21. However, in order to isolate the control valves 22 and 23, a third shuttle valve 48 is provided in the exhaust port 41, and is shiftably movable toward the control valve 23 (as viewed in FIG. 5) in order to provide such isolation in order to allow continued operation of the control valve 22, while the redundant or backup control valve 23 is not functioning. Similarly a fourth shuttle valve 53 is provided in the exhaust port 50 in order to isolate the exhaust ports 51 and 49 of the control valves 23 and 22, respectively. As one skilled in the art will recognize, the shuttle valves 48 and 53 may not be necessary in all applications.

Once the sensor 26 detects a predetermined movement of the piston 15 (or other predetermined system parameter), a signal is transmitted from the sensor 26, through the signal processor 27, to cause the functioning control valve 22 to shuttle or shift to the right (in FIG. 5), thus connecting the right-hand fluid chamber 16 and the load port 35 with the exhaust port 49 on the control valve 22, which in turn is in fluid communication with a second exhaust port 50 on the block or base 21, thus allowing the fluid chamber 16 to be depressurized. Simultaneously, the rightward movement of the control valve 22 serves to connect the supply port 34 in fluid communication with the load port 43, thus allowing for pressurization (by way of the shuttle valve 42) of the left-hand fluid chamber 17. Such simultaneous pressurization of the left-hand fluid chamber 17 and depressurization of the right-hand fluid chamber 16 causes rightward movement of the piston 15, as shown in FIG. 5. In this manner, the fluid-powered cylinder 14, by way of reciprocating motion of the piston 15, functions to perform a desired operation in the given application of the present invention.

In the event of a failure or removal of the previously-functioning control valve 22, which may be detected by the sensor 26 detecting a predetermined malfunctioning position of the piston 15, or other predetermined system malfunction parameter, a signal is transmitted by way of the signal processor 27 to cause deactivation of the control valve 22 and activation of the control valve 23 simultaneously. This "switching" is accomplished in the illustrative example in FIG. 5 by way of the signal processor 27 sending a signal to the selector valve 24, causing rightward-movement thereof and correspondingly connecting the supply port 32 on the selector valve 24 with the supply port 39, which is in fluid communication with the supply port 38 on the control valve 23, thus providing for supply flow through port 37 into the fluid chamber 16, by way of the shuttle valve 36. In this condition, the shuttle valve 36 is shifted rightward in order to prevent supply flow from the control valve 22, thus rendering the control valve 22 inactive. In this condition, as a result of the movement of the selector valve 24, the supply port 35 on the control valve 22 is in fluid communication (by way of the port 33 on the selector valve 24) with the exhaust ports 52 and 50. The control valve 23 then operates in substantially the same way as that described above for the previously-functioning control valve 22.

Figure 6:
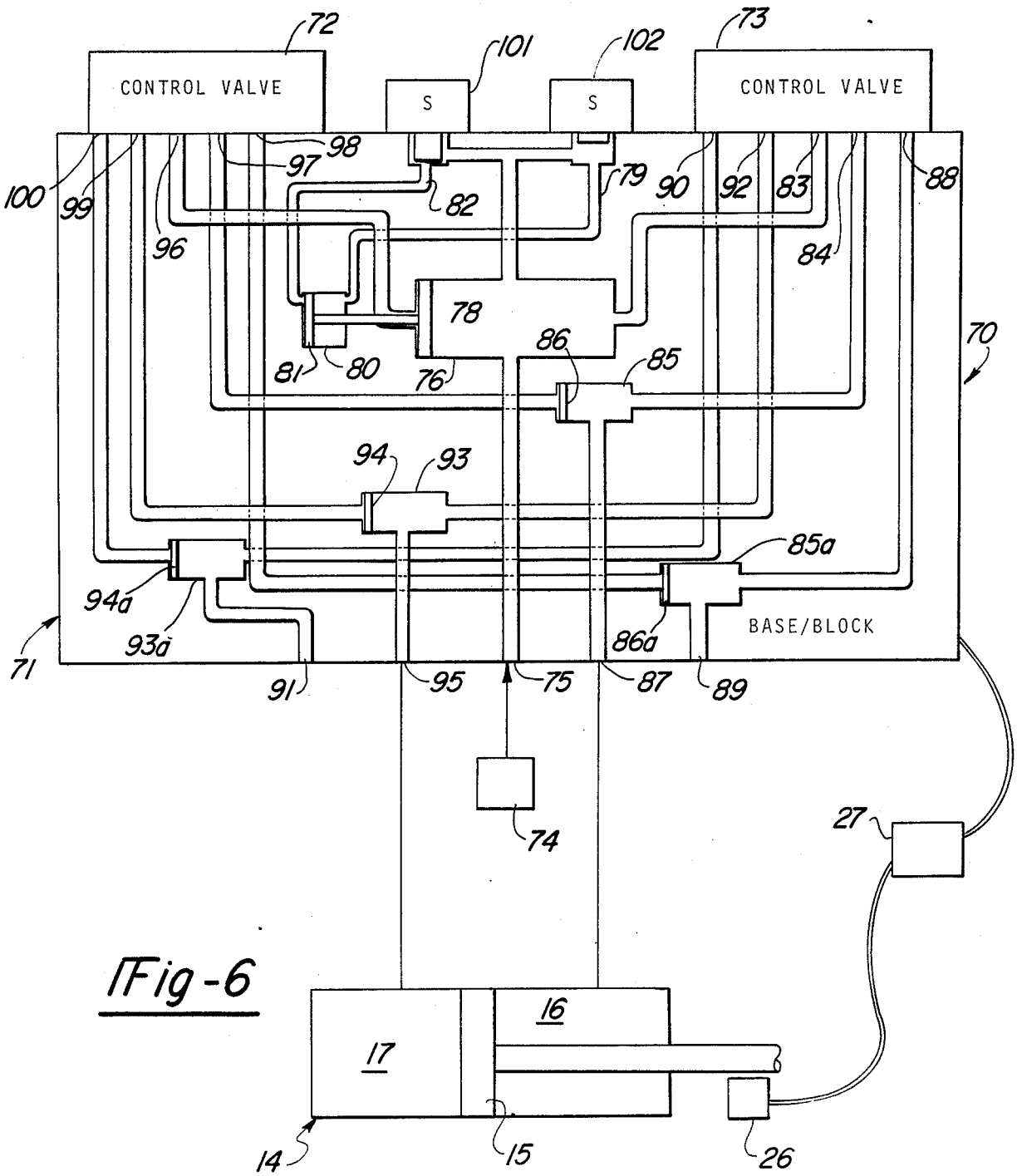
FIG. 6 is a diagrammatic or schematic drawing showing another example of a control system circuit in accordance with FIGS. 3 or 4 for a device, such as a pneumatic or hydraulic motor, for example.

In FIG. 6, a system 70 is illustrated in diagrammatic or schematic form and functions in a manner generally similar to the system 20 described above and shown for purposes of illustration in FIG. 5. In the system 70, however, the selector valve 24 in FIG. 5 is replaced by a series of piston or poppet valves and a solenoid-operated switching system. The functional control valve switching components in the system 70 are schematically illustrated as being embodied in an optional interposed block or integral base 71 for automatically switching operation of a fluid-powered cylinder 14, for example, between two control valves 72 and 73, but can alternately be incorporated into the system base.

In the condition schematically illustrated in FIG. 6, a source of pressurized working fluid is connected in fluid communication with a supply port 75, which in turn is in fluid communication with a switching or shutoff valve 76, which can alternately be either a piston-type valve 76, having a piston 78 therein, or a poppet valve such as that well-known to those skilled in the art. Since the switching valve 76 is in parallel fluid communication with a pair of solenoid-operated valves 101 and 102, which are in turn in parallel fluid communication with a valve operator chamber 80 having a piston 81 therein, which is mechanically connected with the piston 78 in the switching or shut off valve piston 76. Therefore, depending upon which of the solenoid-operated valves 101 or 102 is actuated to be in an open position, the pistons 81 and 78 are forced to either their extreme right-hand or extreme left-hand ends of their travel. Thus, when the piston 78 is in its leftward position, as shown in FIG. 6, the working fluid supply port 75 is in fluid communication with a supply port 83 on the control valve 73, and the control valve 73 is in a functioning condition for controlling the flow of working fluid to and from the fluid-powered cylinder 14.

Working fluid is communicated from the control valve 73 to the cylinder 14 by way of the control valve load port 84, and a piston-type shuttle valve 85 (or poppet valve) is disposed between the control valve load port 84 and the load port 87 in the base or block 71. When the control valve 73 is in a functioning condition so that working fluid is supplied between the ports 83 and 87, the piston 86 in the piston-type valve 85 (or a poppet valve) is forced to its leftward position, as shown in FIG. 6, in order to isolate or block-off fluid communication to a load port 97 on the control valve 72. Likewise, a piston-type shuttle valve 93 (or a poppet valve) is disposed in fluid communication between a load port 92 of the control valve 73 and a load port 95 of the base or block 71. In the functioning condition shown in FIG. 6, the piston 94 in the valve 93 is similarly urged to its leftward position in order to isolate or block-off a load port 99 of the non-functioning control valve 72. Similar shuttle valves **85*a* and 93*a* are disposed between the control valve exhaust ports 88 and 98, and 90 and 100, respectively, and the exhaust ports 89 and 91, respectively. These shuttle valves function in a manner similar to that of the shuttle valves 85 and 93** to selectively isolate the exhaust ports of the non-functioning control valve.

The fluid-powered cylinder 14 functions in a manner generally similar to that described above in connection with FIG. 5, in that working fluid is supplied and withdrawn from the right-hand and left-hand chambers 16 and 17, respectively, by way of the load ports 87 and 95 of the base or block 71, the exhaust ports 88 and 90 of the control valve 73, and the exhaust ports 89 and 91 of the base or block 71.

When a malfunction of the control valve 73 occurs, or if the control valve 73 is removed from the base or block 71 for service, the sensor 26 transmits a signal to the signal processor 27, which can also be a microprocessor, pneumatic signal processor, or other appropriate signal processing means, and the appropriate signal is transmitted to the base or block 71 in order to cause the solenoid-operated valves 101 and 102 to reverse their positions, such that the solenoid-operated valve 101 opens and the solenoid-operated valve 102 closes and vents. Because of the parallel communication of the solenoid-operated valves 101 and 102 with the valve operator 80, the piston is forced to its rightward position, as viewed in FIG. 6, which in turn forces the shuttle piston 78 to correspondingly move to its rightward position. This isolates the supply port 83 of the control valve 73 from the system, and opens fluid flow of the supply fluid to the supply port 96 of the control valve 72, allowing the control valve 72 to supply working fluid through its load ports 97 or 99 to the valves 85 and 93, which causes their respective pistons 86 and 94 to correspondingly move to their positions. Thus, fluid communication is opened between the load ports 97 and 99 of the control valve 72 and the load ports 87 and 95 of the base or block 71. The system then functions as described above to cause reciprocating movement of the piston 15 in the fluid-powered cylinder 14, with the control valve 72 functioning in place of the malfunctioning or removed control valve 73.

Figure 7:
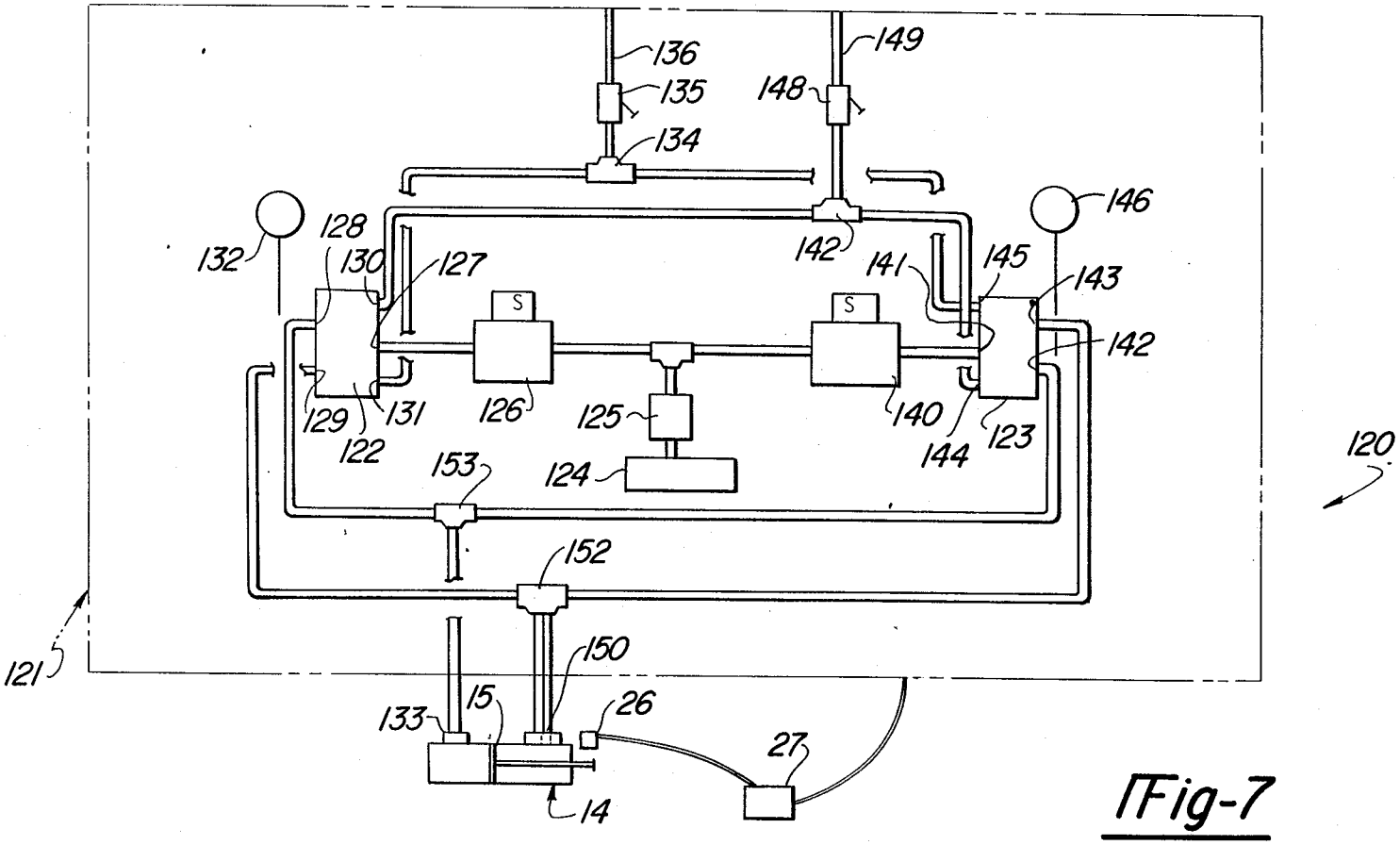
FIG. 7 is a diagrammatic or schematic drawing showing still another example of a control system circuit in accordance with FIGS. 3 or 4 for a device, such as a pneumatic or hydraulic motor, for example.

FIG. 7 schematically or diagrammatically illustrates a system 120, which is generally similar to the system 70 illustrated in FIG. 6, except that the piston-type switching or shutoff valve (or poppet valve) 76 in FIG. 6, with its associated valve operator 80 and solenoid-operated valves 101 and 102, are replaced by in-line switching or shutoff valves 126 and 140 for respectively opening or closing supply fluid flow from the supply source 124 to the respective supply ports 127 and 141 of the control valves 122 and 123. Such in-line valves 126 and 140 can be solenoid-operated valves, as schematically illustrated in FIG. 7, or they can be pneumatically-operated valves, hydraulically-operated valves, or other such controllable shutoff valves well-known to those skilled in the art.

In virtually all other respects, the system 120 functions in the same manner as that described above in connection with the system 70 illustrated in FIG. 6, with the shuttle valves 152 and 153 in the system 120 corresponding to the shuttle valves 85 and 93 in the system 70 of FIG. 6, for opening or blocking flow between the respective load ports 128 and 129 of the control valve 122 and the load ports 142 and 143 of the control valve 123. In addition, however, shuttle valves 134 and 142 are provided between the respective exhaust ports 130 and 131 of the control valve 122 and the exhaust ports 145 and 144 of the control valve 123, thus respectively isolating or opening exhaust flow from the respective control valves and the exhaust ports 136 and 149 of the base or block 121. Check valves 135 and 148 can optionally be added between the shuttle valves 134 and 142, respectively, and the exhaust ports 136 and 149, respectively. As one skilled in the art will now readily recognize, the provision of the shuttle valves 134 and 142 may not be necessary in all applications, as is illustrated for example in the system 70 described above and illustrated in FIG. 6.

Other optional features are also included in the system 120 shown in FIG. 7, such as a supply shutoff valve 125, which can be either a manually or automatically operated valve, and the optional flow meters 132 and 146 for measuring flow from the load ports 128 and 142 of the respective control valves 122 and 123. As with all of the other embodiments of the present invention illustrated and described herein, the various components used for switching between control valves or for isolating and maintaining the system in an "air-on" upon removal of a control valve, can be embodied or housed in a separate, interposed block between the control valve or valves and the system base, or such components can be integrated directly into the system base itself.

Figure 8:
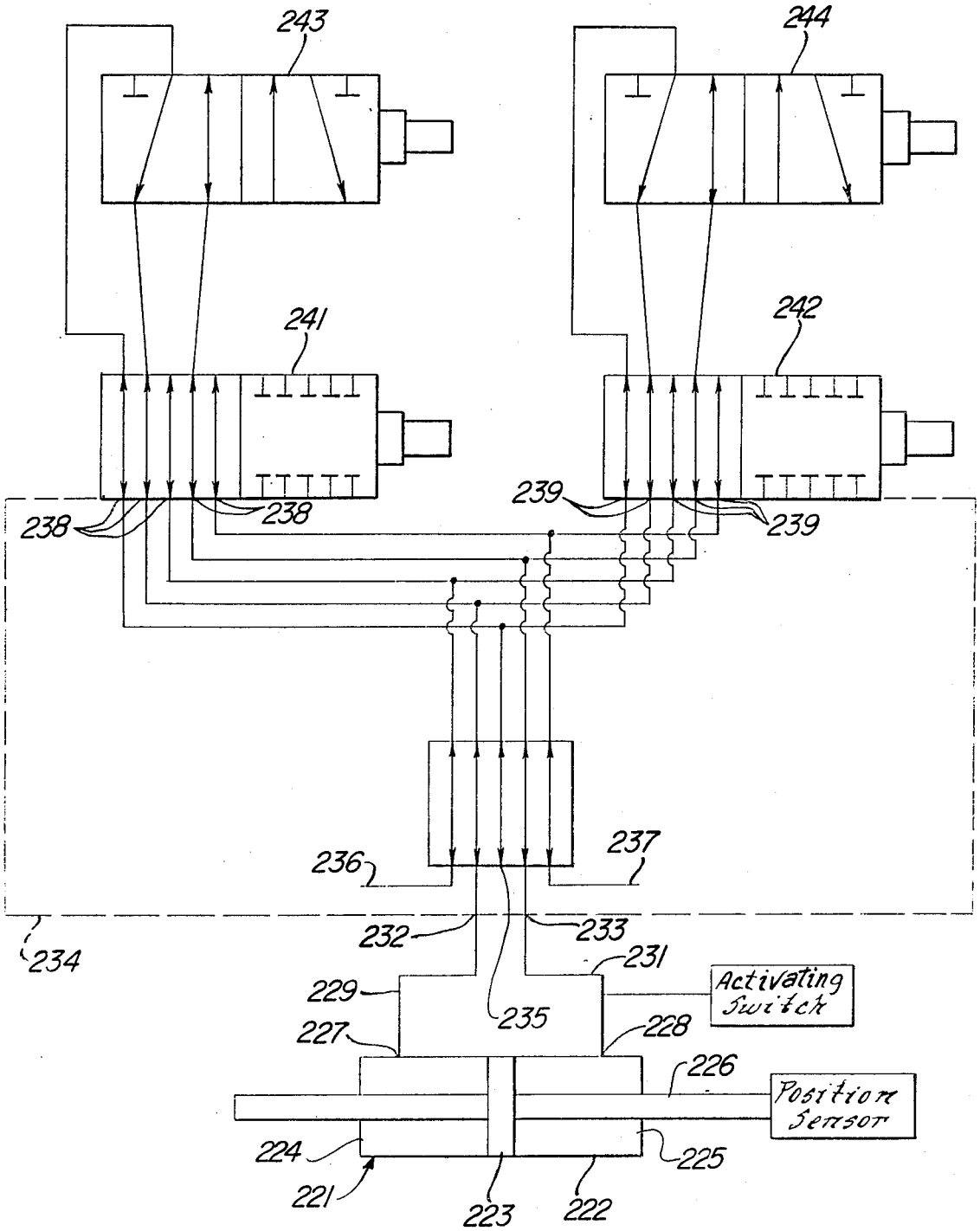
FIG. 8 is a diagrammatic or schematic drawing showing a further example of a control system circuit also in accordance with FIGS. 3 or 4 for a device, such as a pneumatic or hydraulic motor, for example.

Referring to FIG. 8, a fluid operated device such as a pneumatic cylinder or motor is indicated generally by the reference numeral 221 and is of the double acting type. The pneumatic motor 221 has a cylinder 222 in which a piston 223 is supported for reciprocation and which defines a pair of opposing fluid chambers 224 and 225. A piston rod 226 is affixed to the piston 223 and extends through one end of the cylinder 222 for operating virtually any known type of apparatus, such as a press, a machine, or other actuable device.

The cylinder 222 is provided with respective ports 227 and 228 that communicate with the chambers 224 and 225 at the ends of the stroke of the piston 223. Conduits 229 and 231 connect the ports 227 and 228 respectively with ports 232 and 233 of either a base or an interposed interface block, shown schematically and indicated generally by the reference numeral 234.

The base or interface block 234 further has a supply port 235 that is connected to a source of supply pressure (not shown) and a pair of exhaust ports 236 and 237 which lead to the atmosphere, preferably through a muffler (not shown).

The base or interface block 234 is further provided with a first series of ports 238 that are in circuit with the ports 232, 233, 235, 236, and 237 through suitable internal porting or passages in the base or interface block 234. In addition, a second series of ports 239 are also in communication with the ports 232, 233, 235, 236, and 237 through similar internal passages. The passages are such that the ports 238 and the ports 239 are in a parallel circuit with each other.

Mounted to the interface block 234 (or incorporated in the base 234) is a first shutoff valve 241 that communicates with the first series of ports 238 and a second shutoff valve 242 that cooperates with the second series of ports 239. As a result, the shutoff valves 241 and 242 have their respective ports in parallel communication with each other. The shutoff valves 241 and 242 are adapted for mounting interconnection with control valve 243 and 244, respectively. The control valves 243 and 244 are shown for purposes of illustration as two position, two-way control valves, but could also be other multi-position control valves.

The shutoff valves 241 and 242 are operative to selectively communicate the ports 238 and 239, respectively, of the block or base 234 with the various ports of the control valves 243 and 244. The shutoff valves 241 and 242 operate so that when they are in their inactive or "ON" position, the ports 238 and 239 are communicated with the ports of the control valves 243 and 244. When the shutoff valves 241 and 242 are in their active or "OFF" positions, however, the control valves 243 and 244, respectively, are isolated from the ports of the blocks or base 234.

The specific construction of the shutoff valves 241 and 242 can vary in various applications of the invention and can be of the type as will be hereinafter described for purposes of illustration by particular reference to the other Figures of the drawings. Various other types of shutoff valves can be employed that will function in a similar manner in accordance with the illustrated embodiment of the invention.

Because of their parallel relationship, each of the control valves 243 and 244 will communicate with the fluid motor 221 for selectively pressurizing either the port 227 or the port 228 and dumping the other port to exhaust. Both the control valves 243 and 244 and the shutoff valves 241 and 242 can be operated by a solenoid or pilot control valve, for example.

The system can be operated in a number of differing ways, and in one of these alternatives, one of the shutoff valves 241 or 242 will be activated to its shutoff position while the other of the shutoff valves 241 or 242 will be operated to its inactive or open position so that its associated control valve 243 or 244 will control the fluid motor 221. There is provided any of a wide variety of defect or fault switches which can be sensors that detect when one of the control valves 243 or 244 is not properly operating the fluid motor 221. This may be done either by a pressure switch in one of the conduits 229 or 231, a position sensor for sensing the position of the piston rod 226, or a system that senses the actual control valve position or some machine action or inaction. Since such sensors are well known, they are not illustrated in detail in the drawings.

If a fault is sensed, the shutoff valve associated with the failing control valve will be shifted to its shutoff position so that the defective control valve may be replaced. However, due to the parallel circuitry, the fluid motor 221 can be continuously operated by the remaining control valve without any downtime or loss of production. In accordance with various alternate applications of the invention, this can be accomplished either in systems wherein the control valves normally operate alternatively (i.e., wherein only one control valve is in operation at a given time), or in systems wherein the control valves normally operate in parallel with both control valves normally in operation. In the latter instance the failure or removal of one control valve does not completely shut down the system, but rather the invention allows for continued operation on the remaining control valve, thus allowing for continued system operation, albeit, perhaps, at somewhat reduced capacity.

In the illustrative embodiment of FIG. 8, a pair of parallel control valve, shutoff valve arrangements are provided for controlling each of any number of pneumatic motors. With such a parallel arrangement, it can be assured that a defective control valve (or a control valve in need of routine service) can be replaced with little or no loss of operating time. However, the combination of such a shutoff valve and control valve may be utilized in conjunction with other applications of the invention so as to facilitate removable and replacement of a defective control valve without interfering with the operation of other mechanisms of a complete valve circuit. Furthermore, the use of such a shutoff valve permits the rapid replacement of the control valve without appreciable loss of fluid pressure in the system. However, such other applications do not necessarily have the advantage of completely eliminating system downtime.

Figure 9:
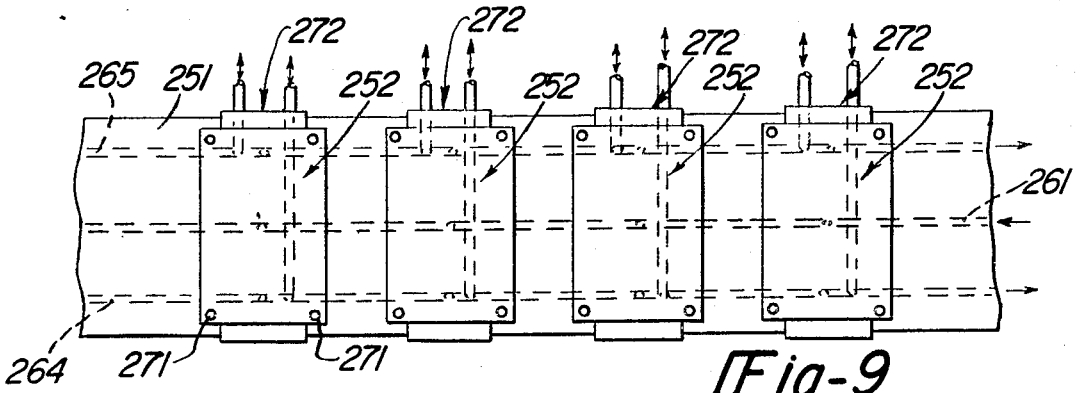
FIG. 9 is a top plan view of a typical arrangement of control valves mounted on a manifold base, showing one arrangement for a shutoff valve assembly of the present invention interposed between the control valves and the manifold base.

A typical environment for one alternate construction of the invention is shown in FIG. 9 wherein a manifold or base is indicated at 251 and a plurality of control valves, indicated generally at 252, are mounted thereon. These control valves could, for example, operate tools along an automated production line (not shown), although the invention is also capable of use with a plurality of control valves used at individual stations with different operators or, as already noted, with a system as shown in FIG. 8.

Figure 10:
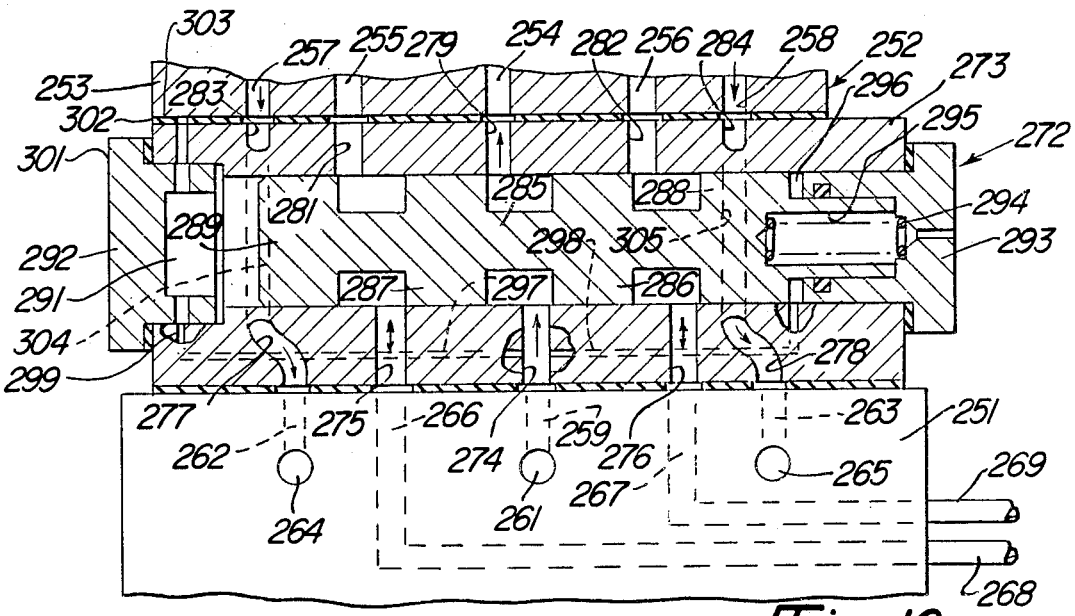
FIG. 10 is a cross-sectional view showing one embodiment of a shutoff valve assembly (for the arrangement of FIG. 9) in its inactive or on position, permitting connections between the manifold base and one of the control valves.

A typical section through a shutoff valve assembly 272 interposed between one of the control valves 252 and the manifold base 251 is shown for purposes of exemplary illustration in FIG. 10. Each control valve 252 has a housing 253 and, in conjunction with the illustrated embodiment of the invention, is shown as having inlet or supply port 254, a pair of outlet ports 255 and 256, and a pair of exhaust ports 257 and 258. Such a control valve would constitute a four-way valve, which in one position conducts pressurized fluid from the supply port 254 to the outlet port 255, while connecting the outlet port 256 to the exhaust port 258. In the opposite position, the supply port 254 would be connected to the outlet port 256, and the outlet port 255 would be connected to the exhaust port 257. The mechanism being supplied and controlled by the control valve 252 could be, for example, a double acting cylinder, such as the cylinder or fluid motor 221 of FIG. 8. The control valve 252 can be operated by a solenoid-controlled pilot valve (not shown). The arrangement can be such that when the solenoid is de-energized, the control valve 252 would be in a position pressurizing port 256 and exhausting port 255. This would mean that the working volume to which the outlet port 256 is connected is filled with pressurized air. Conversely, in such an exemplary arrangement, energization of the solenoid would produce the opposite condition described above.

Conventionally, the control valves 252 have been directly mounted on the manifold or base 251, with the ports 254 through 258 connected to corresponding ports in the manifold or base. For example, the supply port 254 would be aligned with a port 259 in the manifold base which leads from a supply conduit 261. The exhaust ports 257 and 258 would be aligned with ports 262 and 263, respectively, in the manifold or base, with the ports 262 and 263 leading to exhaust conduits 264 and 265, respectively. The outlet or working ports 255 and 256 would be aligned with ports 266 and 267, respectively, in the manifold base, with the ports 266 and 267 leading to outlet conduits 268 and 269 for the machine or device being controlled.

The control valves 252 are conventionally secured to the manifold 251 by suitable fastening means, such as the bolts indicated at 271 in FIG. 9, or by other means, such as quick action clamping devices. Ordinarily, before removing a valve 252 for repair or replacement, it is necessary to first make sure that removal of the valve will not create production or safety problems. At times it has been necessary to provide a shutoff valve for all the control valves 252 thus resulting in the undesirable situation that there is no inlet pressure at any control valve until all control valves are back in place, and thus the entire system must be shut down and production is lost as a result of the failure, servicing or replacement of one control valve.

According to the invention, one shutoff valve assembly, generally indicated at 272, is interposed between each control valve 252 and manifold base 251. The shutoff valve assembly 272 is illustrated as being automatically operated. In certain applications, however, as will be illustratively described in more detail below, other forms of actuation are possible. The shutoff valve 272 preferably has ports which match both the ports at the top of the manifold base 251 and those at the bottom of the control valve 252 so that the same manifold base 251 and control valve 252 may be used, or the shutoff valve 272 can be built into the manifold or base 251 or a portion thereof. The shutoff valve has a housing 273 with a supply port 274 aligned with the manifold port 259, a pair of outlet ports 275 and 276 aligned with the manifold ports 266 and 267, respectively, and a pair of exhaust ports 277 and 278 aligned with the manifold ports 262 and 263, respectively. Corresponding ports are formed at the top of the housing 273, with a supply port 279 being aligned with the control valve port 254, outlet ports 281 and 282 aligned with the control valve ports 255 and 256, respectively, and exhaust ports 283 and 284 aligned with the control valve ports 257 and 258, respectively.

A spool valve member 285 is slidably mounted in the housing 273. This valve member is movable between an inactive or "ON" position shown in FIG. 10 and an active or shutoff position shown in FIG. 11. The spool valve member has a first lobe 286, which in the inactive or "ON" position is clear of the supply port 274, but which in the active or shutoff position of FIG. 11 blocks the supply port 274. A lobe 287 on the spool 285 is clear of the port 275 in the inactive or on position, but blocks the port 275 in the shutoff position. A third lobe 288 is retracted from the outlet port 276 in the inactive or on valve position but blocks this port in the shutoff position of FIG. 11.

A fourth lobe 289 is provided on end of spool 285, which functions as a piston facing a chamber 291 which is formed by an end cover 292 on the housing. A second end member 293 at the other end serves to support a pilot portion formed on that end of the spool 285 and also supports one end of a helical coil compression spring 294 located within a bore 295 of the pilot portion of the spool 285. This spring biases the spool 285 toward the shutoff position. A chamber 296 is formed between the end member 293 and lobe 288, which thus also acts as a piston of lesser effective area than the piston formed by the lobe 289.

A pair of passages 297 and 298 lead from the supply port 274 to opposite ends of housing 273. The passage 297 leads through a relatively small restriction 299 to the chamber 291, and then has a relatively unrestricted passage 301 leading from the chamber 291 to the top of housing 273. A gasket 302 is normally interposed between the valve 252 and the housing 273 and has an opening 303 aligned with the passage 301. Thus, when the valve 252 is clamped in position as shown in FIG. 10, the passage 301 will be blocked, but when the valve 252 is removed, the passage 301 will be open, immediately evacuating the chamber 291. The passage 298 leads relatively unrestrictedly to the chamber 296 and thus aids the spring 294 in constantly urging the spool 285 to its shutoff position. The effective area of the lobe 289 is large enough, however, to overcome the forces of the lobe 288 and the spring 294 when the chamber 291 is pressurized.

In operation, assuming that the control valve 252 is installed and operating properly, fluid pressure in the chamber 291 will hold the spool 285 in its inactive position shown in FIG. 10. When in this position an open connection exists between the supply ports 274 and 279, through the space between the lobes 286 and 287. Similarly, clear passages exist between the outlet ports 275 and 281 and between the outlet ports 276 and 282. The exhaust ports 257 and 262 will be connected by way of a passage 304 connecting ports 277 and 283, and the exhaust port 258 will be connected to exhaust port 263 by way of the passage 305 linking ports 278 and 284. All the control valves 252 may thus be operated in their normal manner.

Should it be desired to remove any of the control valves 252 for repair or replacement, it is merely necessary to remove the fasteners 271 or unclamp the control valve 252 if it is held in place by a clamping device. As soon as the valve 252 is lifted off its gasket 302, the chamber 291 will be depressurized, since the restriction 299 is narrower than the passage 301. The valve spool 285 will be immediately shifted to the left as a result of the spring 294 and the pressure in the chamber 296. This will have the effect of immediately shutting off the supply pressure from the manifold base 251 and also shutting off the two outlet ports 266 and 267. This tends to avoid a drop in supply pressure which could adversely affect the remaining control valves 252. Thus quick replacement of a control valve is possible without shutting down the complete operation, in turn resulting in little or no loss of system production.

When the previously removed control valve 252 is replaced, and as soon as it is clamped or secured in position by the fasteners 271, in order to sealingly close the passage 301, fluid pressure will again build up in chamber 291. The shutoff valve will, after a short but predetermined time interval, shift back from its shutoff position of FIG. 11 to its inactive or on position of FIG. 10, and the control valve 252 can then be operated as usual.

It should also be observed that any electrical connections to control valve 252 can also be led through the housing 273 and the housing 253 so that when the control valve 252 is removed, electrical connections will automatically be disconnected, if desired in a given application.

It should also be understood that the shutoff valve assembly 272 can also be employed in an arrangement of the type shown in FIG. 8. In such an application, the valve can be operated in the manner as described in conjunction with the embodiments of FIGS. 9 through 11; however, it would be more advantageous if the shutoff valve assembly in such an application were electrically operated, as described in conjunction with FIG. 8. Of course, electric or other forms of operation are also possible in connection with the embodiments shown in FIGS. 9 through 11.

Figure 11:
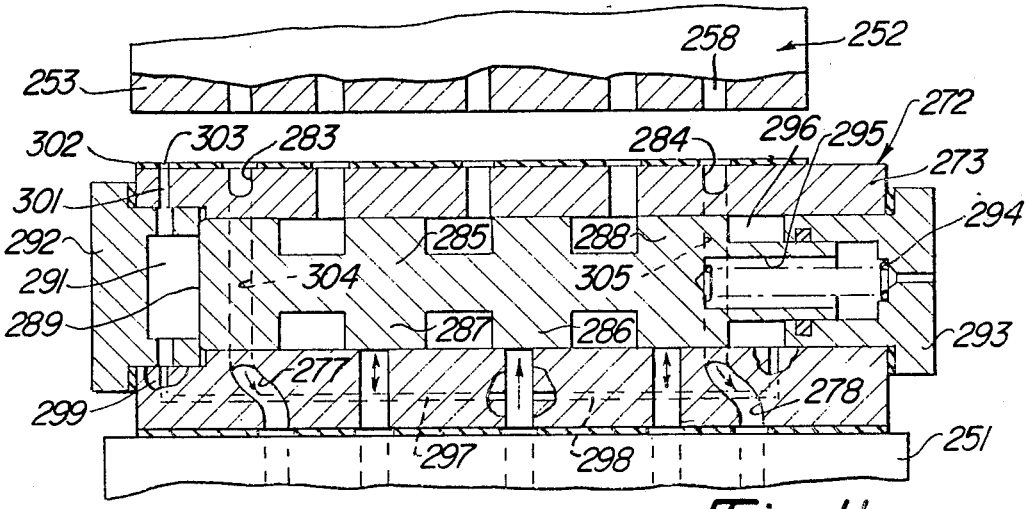
FIG. 11 is a cross-sectional view in part similar to FIG. 10, showing the control valve removed and the shutoff valve assembly shifted to its shutoff position closing the manifold base ports.
Figure 12:
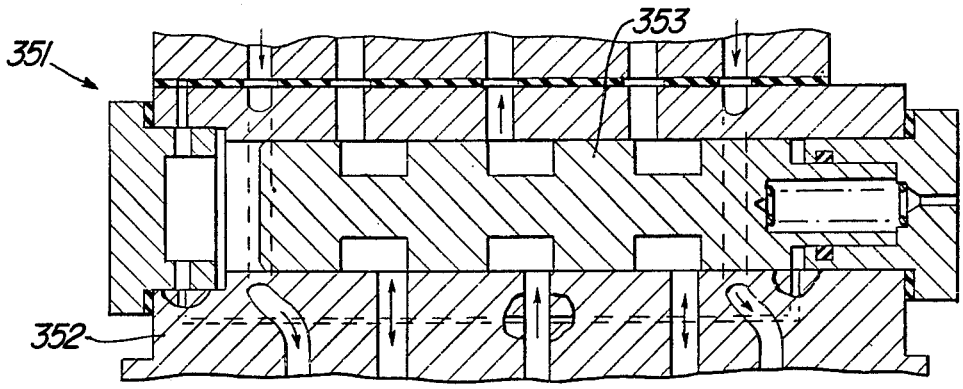
FIG. 12 is a cross-sectional view similar to FIG. 10, showing another embodiment of the invention in which the housing of the shutoff valve assembly is combined with the base.

FIG. 12 shows another illustrative embodiment of the invention, generally indicated at 351, which is similar to the embodiment of FIGS. 9 through 11, but combines the shutoff valve housing with the manifold or base. The combined shutoff valve and base housing is indicated at 352, and the shutoff valve spool at 353. The operation of this embodiment is substantially identical with that of the previous embodiment described above.

Figure 13:
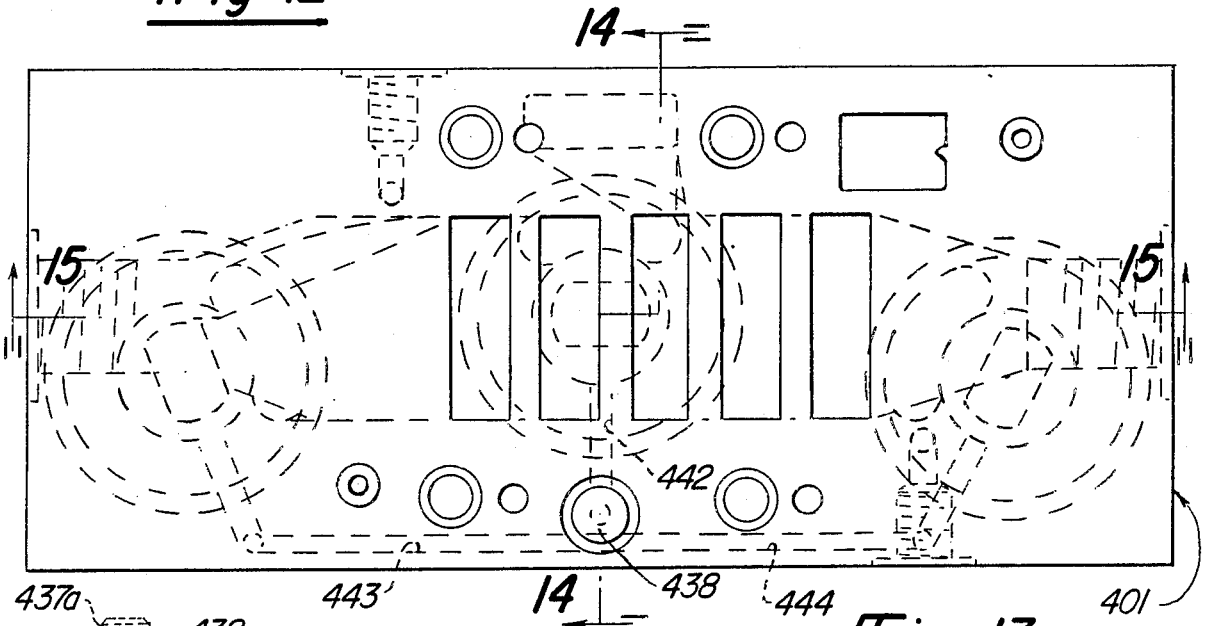
FIG. 13 is a top plan view of still another embodiment of the invention utilizing poppet valves.
Figure 14:
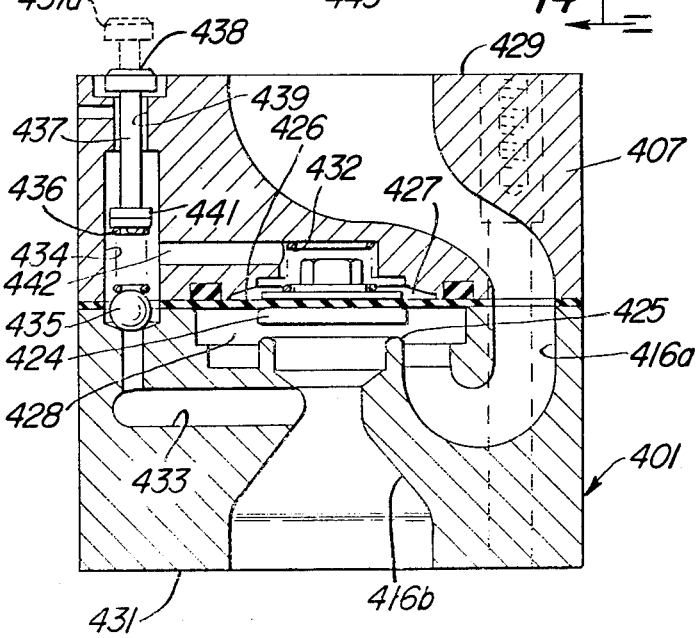
FIG. 14 is a cross-sectional view in elevation taken generally along the lines 14—14 of FIG. 13 and showing the construction of one of the valves as well as a plunger control.
Figure 15:
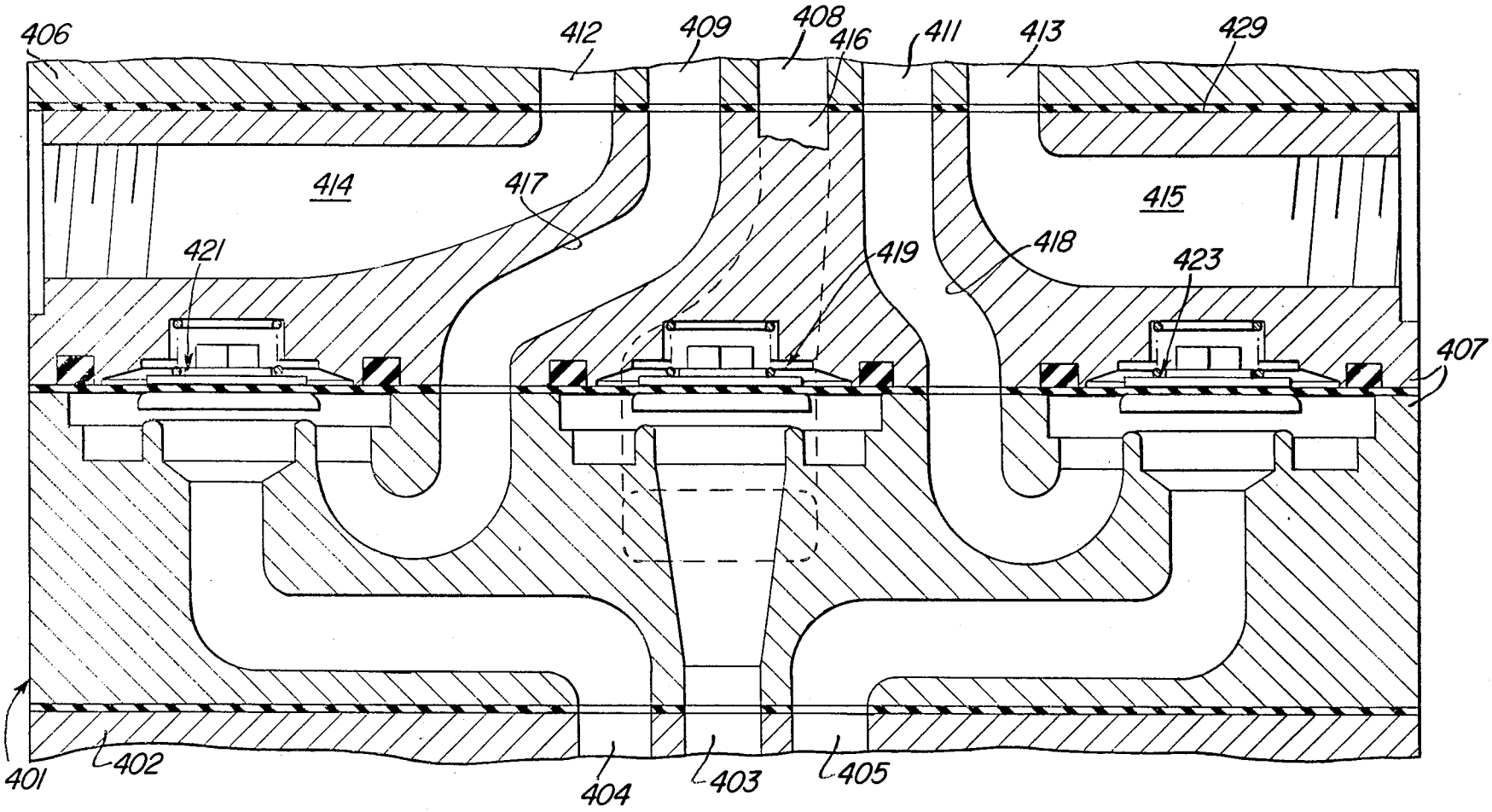
FIG. 15 is an enlarged cross-sectional view of the construction of FIG. 13, taken along line 15—15 of FIG. 13.

FIGS. 13, 14 and 15 show an illustrative shutoff valve constructed in accordance with still another embodiment of the invention, which utilizes poppet valves instead of spool valves, and actuates the valves by pressurizing rather than exhaustion. The shutoff valve assembly is generally indicated at 401 and is mounted on a base 402 (shown partially in FIG. 15) having a supply passage 403 and a pair of working passages 404 and 405. A control valve 406 (shown partially in FIG. 15) is mounted on the housing 407 of the shutoff valve 401 and has a supply passage 408, working passages 409 and 411, and exhaust passages 412 and 413. A passage 414 in the housing 407 connects the exhaust passage 412 to the atmosphere, and a passage 415 connects the exhaust passage 413 to the atmosphere.

A supply passage 416 is provided in the housing 407 and connects the base supply passage 403 with the control valve supply passage 408. Similarly, the working passages 417 and 418 connect corresponding working passages of the base 402 and the control valve 406.

Three poppet valves generally indicated at 419, 421, and 423 are provided in the passages 416, 417, and 418, respectively, with the construction of a typical poppet valve being shown in FIG. 14. The poppet valve assembly has a valve member 424 facing a seat 425 and carried by a diaphragm 426. The diaphragm 426 separates an upper chamber 427 from a lower chamber 428. The valve seat 425 is in the lower chamber 428, and both parts (416*a* and 416*b*) of the passage 416 lead to this lower chamber 428. For example, as shown in FIG. 15, the upper passage portion 416*a* from the upper surface 429 of the housing 407 leads around to the lower chamber 428 outside the seat 425. The lower passage portion 416*b* of the passage 416 leads from inside the seat 425 to the lower surface 431 of the housing 407. Thus pressure in either the passage portion 416*a* or the passage portion 416*b* will lift the valve member 424 from the valve seat 425 as long as no pressure exists in the upper chamber 427. A spring 432 is provided above the diaphragm 426 for biasing and urging the valve member 424 against the seat 425. The effective area within the seat 425 is less than that of the chamber 427 so that pressure in chamber 427 will hold the valve member 424 closed.

A passage 433 (FIG. 14) leads from the lower passage portion 416*b* to a chamber 434. A valve 435 is interposed between the passage 433 and the chamber 434 and is held closed by a spring 436 when the spring is depressed by a plunger 437. The upper end 438 of the plunger 437 protrudes above the gasket mounting surface 429 except when the control valve 406 is mounted thereon. An exhaust passage 439 leads from the chamber 434 to the atmosphere, but is blocked by a seal 441 on the plunger 437 when the plunger 437 is allowed to be fully raised by spring 436, as shown in the fully raised position 437*a*. The passages 442, 443, and 444 (shown in FIG. 13) lead from chamber 434 to the chambers 427 above each of the valves 419, 421, and 423, respectively.

In operation of the embodiment of FIGS. 13 through 15, when the control valve 406 is mounted on the shutoff valve assembly 401, the parts will be in the position shown in FIG. 15, with the plunger 437 depressed and the valve 435 closed. The three chambers 427 above the shutoff valves 419, 421, and 423 will be vented, and the valves 419, 421, and 423 will stay open, permitting normal operation of the control valve 406. It should be noted that the two working passage shutoff valves 421 and 423, can open and close between surges of air pressure in either direction, but this will not interfere with the operation of the system.

When the control valve 406 is removed for repair or replacement, the spring 436 will immediately lift the plunger 437 to the position 437*a*, thus closing the vent 439 and permitting the valve 435 to be lifted. This will allow the fluid to pressurize chambers 427 causing all three shutoff valves 419, 421, and 423 to be immediately closed to prevent leakage and to permit the remainder of the system to operate normally, thus preventing or at least substantially minimizing lost production time. The valves 419, 421, and 423 will remain in their shutoff position until the control valve 406 is replaced, thus depressing plunger 437 and venting the chambers 427 and closing the valve 435, in turn permitting all three of the shutoff valves 419, 421, and 423 to move to their inactive positions.

In the embodiments of FIGS. 1 through 15, as thus far described, the shutoff valves are operative to close communication between a base and a control valve (or the atmosphere) immediately upon removal of the control valve. In each case, this is accomplished by an arrangement which senses the presence of the control valve and which activates the shutoff valve to its closed or shutoff position when the control valve is removed. In some instances, it may be desirable to operate the shutoff valve so that it will shut off the communication between the base and the control valve before the control valve is actually removed. With the shutoff valves thus far described, this may be done either manually or automatically by means of a remote or automatically controlled operator that is responsive to some signal other than removal of the control valve, such as a failure signal, for example.

Figure 16:
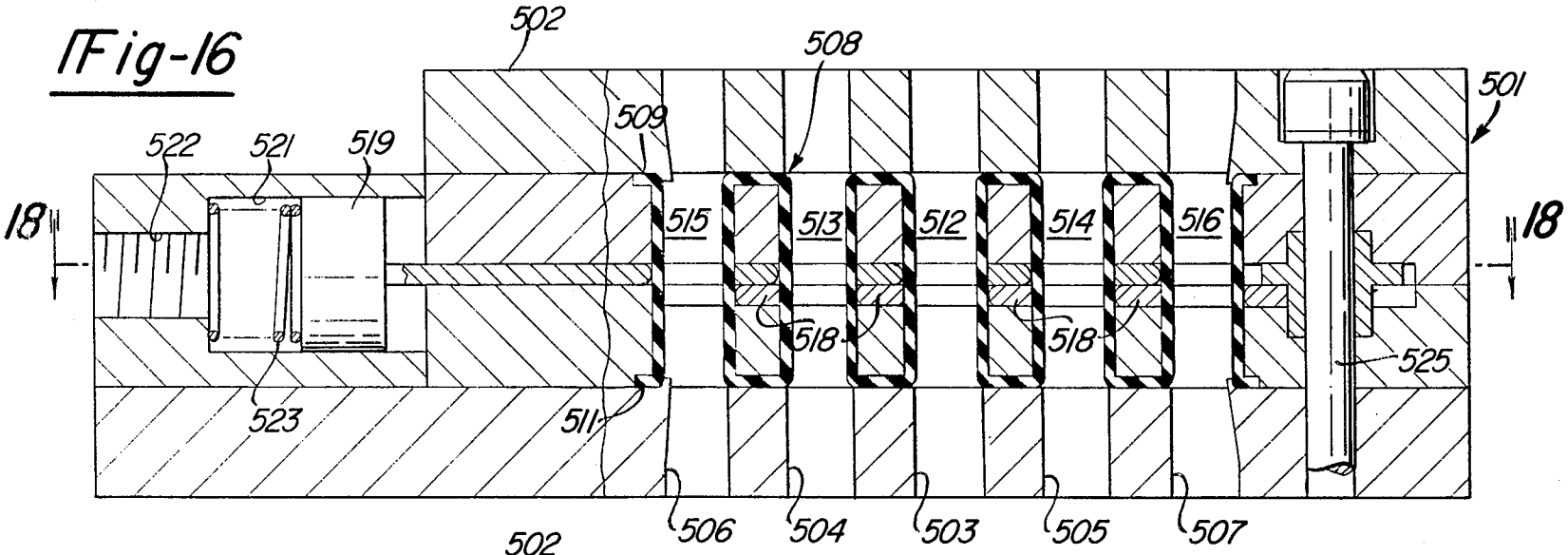
FIG. 16 is a cross-sectional view taken through a shutoff valve assembly constructed in accordance with yet another embodiment of the invention and shows the valve in its inactive or on position.
Figure 17:
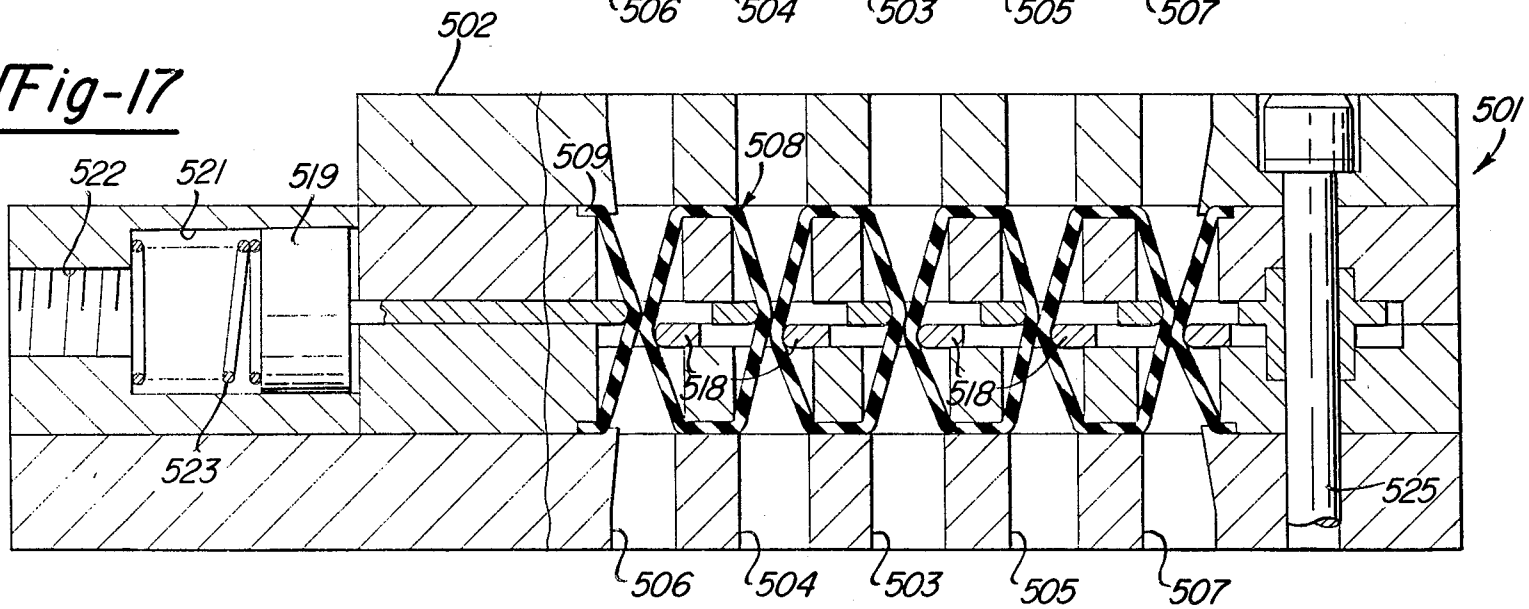
FIG. 17 is a cross-sectional view, in part similar to FIG. 16, showing the shutoff valve assembly in its shutoff position.
Figure 18:
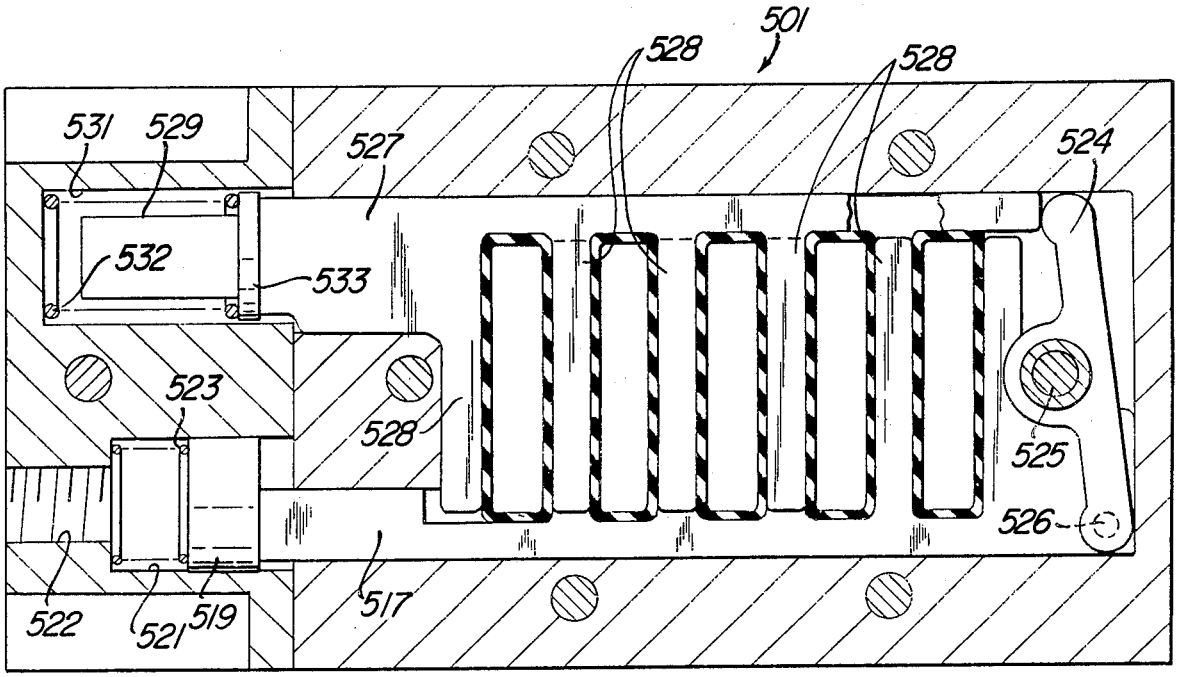
FIG. 18 is a cross-sectional view taken along the line 18—18 of FIG. 16.
Figure 19:
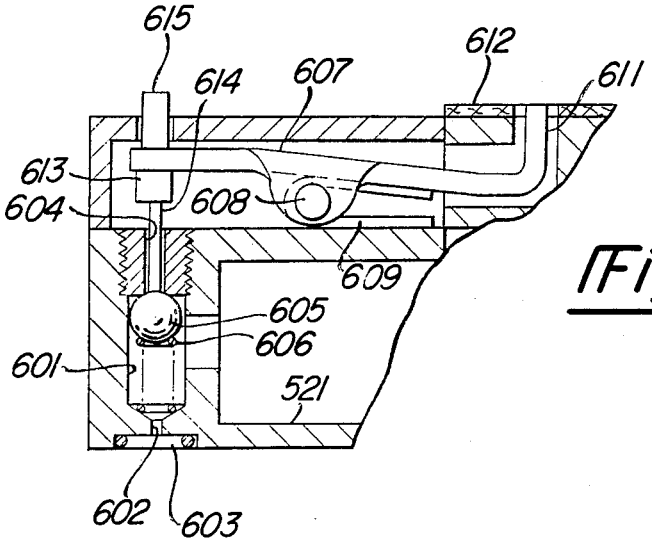
FIG. 19 is a partial cross-sectional view, in part similar to FIG. 16, showing another embodiment of the invention.
Figure 20:
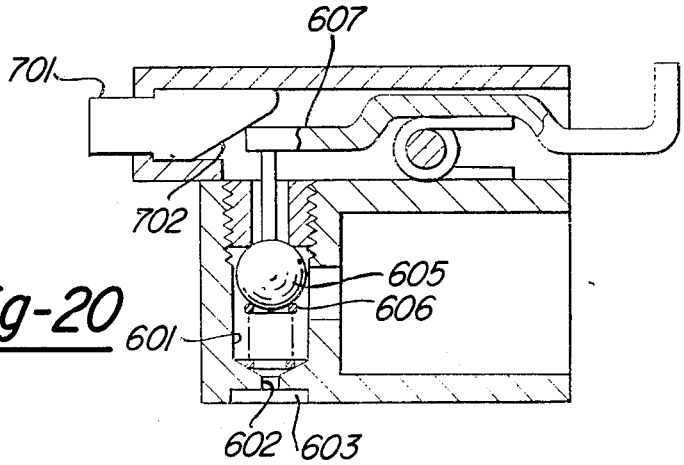
FIG. 20 is a partial cross-sectional view, in part similar to FIGS. 16 and 19, showing still another embodiment of the invention.

FIGS. 16 through 18 show another embodiment of a shutoff valve assembly that can be operated by way of a pilot valve or other activating apparatus in response to any of a variety of conditions. FIGS. 19 and 20 show how this type of assembly can be modified so as to also be automatically operative in response to removal of the control valve, and/or to be manually operated, if desired. Such manual or other forms of automatic operation can readily be applied to the shutoff valve assemblies already described. It should again be emphasized that in any of the embodiments of the invention, the shutoff valve apparatus can be housed in an interface block interposed between the control valve and the base or incorporated into the base onto which the control valve is directly mounted.

Referring to FIGS. 16 through 18, a shutoff valve assembly constructed in accordance with this embodiment of the invention is identified generally by the reference numeral 501. As with the previously described embodiments, the illustrated shutoff valve assembly 501 is designed to be interposed between a control valve and a base for selectively operating a fluid operated device, but can alternately be incorporated into the base. The shutoff valve assembly 501 includes a housing 502, which is illustrated as being made up of a multiple part construction, and which is formed with a supply passage 503, a pair of working passages 504 and 505, and a pair of exhaust passages 506 and 507. As with the previously described embodiments, the supply passage 503 is adapted to register between a supply passage of the base and a supply passage of the control valve, while the working passages 504 and 505 have a similar relationship to the working passages of the base and control valve, and the exhaust passages 506 and 507 likewise have a similar relationship to the exhaust passages of the base and the control valve.

An elastic body, indicated generally by the reference numeral 508, is positioned within the housing 502 and has an upper flange 509 and a lower flange 511, which are clamped between the components of the valve housing 502. The elastic body 508 also defines a plurality of passages 512, 513, 514, 515, and 516, which are aligned with the passages 503 through 507, respectively.

A scissors-like actuating mechanism cooperates with the elastic body 508 for closing the passages 512 through 516 simultaneously. This scissors-like mechanism includes a first or lower slidably supported plate 517 (see FIG. 18) that has individual fingers 518 that extend into the area adjacent the resilient member passages 512 through 516. The plate 517 has a piston portion 519 formed at one end thereof that is slidably received within a bore 521 formed in the valve housing 502. In the illustrated embodiment, a fitting 522 extends through the housing 502 for connecting the bore 521 to a source of air pressure via a pilot control valve (not shown). A relatively light coil compression spring 523 is also contained within the bore 521 for urging the member 517 to the right, as shown in FIG. 17.

A bell crank 524, shown in FIG. 18, is pivotally supported at the opposite end of the valve housing 502 on a pivot shaft 525. The pivot shaft 525 may be formed by a bolt, pin, or the like, which is received within, and fixed to, the housing 502 in a known manner. A pivot pin 526 pivotally connects one end of the slidably supported plate 517 with one arm of the bell crank 524 so that reciprocation of the plate 517 will cause pivotal movement of the bell crank 524.

The opposite arm of the bell crank 524 is engaged with an upper slidably supported plate 527. Like the plate 517, the upper plate 527 is formed with a plurality of fingers 528 that extend between the passages 512 through 516. The plate 527 has a projecting end portion 529 that is received in a recess 531 of the housing 502. A coil compression spring 532, which is stronger than the spring 523, is received within the recess 531 and engages a shoulder 533 on the plate 527 for urging the plate against the arm of the bell crank 524.

When the shutoff valve 501 is in its opened or inactive position, the bore 521 is pressurized through the fitting 522 in order to urge the plate member 517 to the right. This movement, as has been noted, effects pivotal movement of the bell crank 524 so as to urge the plate 527 to the left, resulting in a condition such that the fingers 518 and 528 do not deflect the resilient body 508, and the passages 512 through 516 will be maintained in an open position, as shown in FIGS. 16 and 18.

If it is desired to close the shutoff valve assembly 501, the chamber 521 is depressurized by venting through the fitting 522 to the atmosphere. This can be done when it is desired to remove the control valve, or when the associated control valve malfunctions, and such venting occurs in response to a sensed, predetermined condition. In this illustrated embodiment, this depressurization is done by operating the associated pilot valve to its shutoff position. When the chamber 521 is depressurized, the action of the spring 532 will overcome the action of the spring 523 and the plate 527 will be shifted to the right, as shown in FIG. 17. This movement will resultantly effect pivotal movement of the bell crank 524 in a clockwise direction from the position shown in FIG. 18 to a position wherein the plate 517 is shifted to the left. As such, the fingers 518 and 528 will be shifted to the position shown in FIG. 17, wherein they deflect the resilient body 508 and pinch the passages 512 through 516 to a closed condition. As a result, the control valve can be removed with no loss of pressurization or deactivation of the remaining components of the system.

FIG. 19 shows another embodiment which is basically the same as the embodiment of FIGS. 16 through 18 but wherein there is provided an automatic control for the shutoff valve 501 with a further manual operator. As seen in this embodiment, the bore 521 communicates with a valve chamber 601 which has a restricted lower opening 602 that communicates with a passage 603 that is adapted to register with a supply port such as the port or passageway 259 of the embodiment of FIGS. 9 through 11. Hence, the bore 521 is normally pressurized through the opening 603, restricted passageway 602 and valve chamber 601 to the supply pressure for holding the shutoff valve 501 in its opened position. An atmospheric vent passage 604 is provided at the upper end of the valve chamber 601, which is normally closed by means of a ball type valve 605 that is urged to this closed position by a coil compression spring 606.

An actuating lever 607 is pivotally supported within the valve housing on a horizontally extending pivot pin 608. A torsional spring 609 normally urges the actuating lever 607 for rotation in a counterclockwise direction so that a projection 611 of the lever 607 will extend upwardly through the gasket 612 that is interposed between the shutoff valve 501 and the associated control valve (not shown). When the control valve is in position, the projection 611 will be urged downwardly and the lever 607 will be pivoted in a clockwise direction to the position shown in FIG. 19.

The end of the lever 607 opposite to the projection 611 has a depending cylindrical part 613 that engages a push rod 614 that is slidably supported within the opening 604 and which is adapted to engage the ball 605 when the lever 607 is rotated by the action of the torsional spring 609. Under this condition, the ball 605 will become unseated and the bore 521 will be vented to the atmosphere so as to depressurize this chamber and permit the valve 501 to move to its closed position as shown in FIG. 17. This operation is quite similar to the operation of the embodiment of FIGS. 9 through 12.

The lever 607 is also provided with a projecting portion 615 that is accessible externally so that an operator may depress the projection 615 and pivot the lever 607 to a position for opening the ball valve 605 and venting the chamber 519 so long as a control valve is not in position and preventing such movement.

FIG. 20 shows an embodiment which is generally similar to the embodiment of FIG. 19. In this embodiment, however, there is provided a sliding plunger 701 that has a tapered end portion 702 that is adapted to engage the lever 607 for manually opening the ball valve 605.

The shutoff valve assemblies thus far described are particularly useful in permitting replacement of a control valve without closing down or shutting down a complete system. As has already been noted, each shutoff valve assembly thus far described can be operated so as to automatically shut off the fluid connections in response to removal of the control valve. However, as one skilled in the art will now recognize, the shutoff valve assemblies can also be operated in response to a wide variety of other factors, such as by pilot controls, microprocessor circuits or the like, wherein the shutoff valve assemblies can be moved to their closed positions in the event there is a failure sensed in the associated control valve or anywhere else in the overall system. However, each of these shutoff valve assemblies can be used very advantageously in a system wherein even the associated device being operated need not necessarily be rendered inoperative if there is a failure in a control valve for its activating circuit as shown in the various drawing figures.

It should be readily apparent from the foregoing description that a number of embodiments of switching or shutoff valves have been illustrated and described, and which can be operated either automatically upon removal of a control valve, which can be shut off in another manner so as to permit removal of the control valve, and which can be used in combination with each other to provide a system for operating a fluid device continuously even though its operating control valve may malfunction. Although a number of embodiments of the invention have been illustrated and described, various changes and modifications may be made without departing from the spirit and scope of the invention, as defined by the appended claims.

What is claimed is:

1. A control valve arrangement for a system having a powered device and a system base in fluid communication with the powered device, the powered device having a plurality of ports for selective communication with a source of working fluid pressure or exhaust, a first control valve movable between at least two positions for controlling the powered device, a second control valve movable between at least two positions for controlling the powered device, circuit means for connecting said first and said second control valves in parallel communication with said source of working fluid pressure and with the ports of said powered device, and switching valve means located in said circuit means and cooperable with said first and said second control valves for selectively isolating the respective control valves from said source of working fluid pressure and from the ports of the powered device in order to allow replacement of one of said control valves while the other of said control valves controls the powered device, said switching valve means including a plurality of ports adapted to communicate with respective ports of the control valves, and wherein said switching valve means is housed in one of either a block interposed between the control valves and the system base or in the system base.

2. In combination with at least a pair of control valves and at least one control valve base in a fluid control system, the control valves having control valve mounting surfaces, the improvement comprising a shutoff valve apparatus interposed between the control valves and the base, said shutoff valve apparatus having at least one shutoff valve apparatus surface with which said control valve mounting surfaces are matable and to which said control valve mounting surfaces are removably mountable, matching supply and outlet ports in said control valve mounting surfaces and in said shutoff valve apparatus surface, supply and outlet passages in said shutoff valve apparatus connected to said supply and outlet ports in said control valve mounting surfaces and in said shutoff valve assembly surface, respectively, shutoff valve means shiftably mounted in said supply and outlet passages and movable between open and shutoff positions, and means responsive to a first predetermined condition in said fluid control system for activating said shutoff valve means to a shutoff position with respect to one of said control valves and to an open position with respect to the other of said control valves, said shutoff valve means also being responsive to a second predetermined condition in said fluid control system for activating said shutoff valve means to an open position with respect to said one control valve and to a closed position with respect to said other control valve.

3. The combination according to claim 2, wherein said shutoff valve means comprises a slidable valve.

4. The combination according to claim 3, wherein said slidable valve comprises a spool valve.

5. The combination according to claim 3, wherein said slidable valve comprises a piston-type valve.

6. The combination according to claim 2, wherein said shutoff valve means comprise a poppet valve.

7. The combination according to claim 6, wherein said poppet valve is diaphragm operated.

8. The combination according to claim 2, wherein said second predetermined condition is a malfunction of said one control valve.

9. The combination according to claim 2, wherein said shutoff valve apparatus is incorporated into said base.

10. The combination according to claim 2, whèrein said shutoff valve apparatus is a separate structure interposed between said control valves and said base.

11. The combination according to claim 2, wherein said fluid control system is connected for operation of a fluid-powered device, the fluid-powered device having a member movable in response to operation of the fluid control system, said first predetermined condition being a first predetermined position of said movable member, said second predetermined position being a second predetermined position of said movable member.

12. The combination according to claim 2, wherein said shutoff position shuts off fluid communication through both said supply and outlet ports between said supply and outlet ports in one of said control valve mounting surfaces and said shutoff valve apparatus, respectively.

13. The combination according to claim 12, wherein said shutoff valve apparatus includes at least one exhaust passage connected to corresponding respective exhaust ports in said control valve mounting surfaces and said shutoff valve apparatus surface, respectively, said shutoff position also shutting off fluid communication between said exhaust ports in one of said control valve mounting surfaces and said shutoff valve apparatus surface, respectively.

* * * * *

UNITED STATES PATENT AND TRADEMARK OFFICE

CERTIFICATE OF CORRECTION

PATENT NO. :4,930,401

DATED :June 5, 1990

INVENTOR(S) :Cameron, et al

It is certified that error appears in the above-identified patent and that said Letters Patent is hereby corrected as shown below:

Column 4, line 34, "lines" should be --line--.

Column 8, line 39, "shut off" should be --shutoff--.

Column 8, line 39, delete "piston".

Column 9, line 27, after "piston" insert --81--.

Column 11, line 13, "blocks" should be --block--.

Signed and Sealed this

Nineteenth Day of November, 1991

*Attest:*

HARRY F. MANBECK, JR.

*Attesting Officer*

*Commissioner of Patents and Trademarks*